US011767726B2

(12) United States Patent
Lau et al.

(10) Patent No.: US 11,767,726 B2
(45) Date of Patent: Sep. 26, 2023

(54) SEPARABLE HOUSING ASSEMBLY FOR TUBULAR CONTROL CONDUITS

(71) Applicant: HALLIBURTON ENERGY SERVICES, INC., Houston, TX (US)

(72) Inventors: Wee Kiang Jeremy Lau, Singapore (SG); Fangzhou Zhou, Singapore (SG); Zun Kai Chiam, Singapore (SG); Ravi Kumar Krishne Gowda, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 253 days.

(21) Appl. No.: 17/311,601

(22) PCT Filed: Jan. 7, 2019

(86) PCT No.: PCT/US2019/012548

§ 371 (c)(1),
(2) Date: Jun. 7, 2021

(87) PCT Pub. No.: WO2020/145939

PCT Pub. Date: Jul. 16, 2020

(65) Prior Publication Data

US 2022/0018200 A1 Jan. 20, 2022

(51) Int. Cl.

| | |
|---|---|
| ***E21B 29/00*** | (2006.01) |
| ***E21B 17/02*** | (2006.01) |
| ***E21B 33/13*** | (2006.01) |

(52) U.S. Cl.

CPC ..... *E21B 29/00* (2013.01); *E21B 17/02* (2013.01); *E21B 33/13* (2013.01)

(58) Field of Classification Search

CPC ..... E21B 29/00; E21B 17/02; E21B 33/13; E21B 41/00

See application file for complete search history.

(56) References Cited

U.S. PATENT DOCUMENTS 3,266,571 A * 8/1966 St John ..... E21B 29/00 451/75
5,074,361 A * 12/1991 Brisco ..... E21B 29/00 166/240
6,789,627 B2 9/2004 Leismer
(Continued)

OTHER PUBLICATIONS

International Search Report and Written Opinion, PCT Application No. PCT/US2019/012548, dated Oct. 7, 2019.

*Primary Examiner* — Steven A MacDonald
(74) *Attorney, Agent, or Firm* — NOVAK DRUCE CARROLL LLP

(57) ABSTRACT

Apparatus can have a separable housing having a longitudinal length extending along a longitudinal axis with an upper portion and a lower portion. One or more tubular control conduits can be disposed within the separable housing and extend along the longitudinal axis. The one or more tubular control conduits can have an inner bore formed therein. One or more actuation elements can be coupled with the separable housing and be operable to separate the upper portion and the lower portion of the separable housing. The one or more actuation elements can also be operable to separate the one or more tubular control conduits, thereby interrupting the inner bore of the one or more tubular control conduits.

17 Claims, 8 Drawing Sheets

(56) References Cited

U.S. PATENT DOCUMENTS

| | | | | |
|---|---|---|---|---|
| 7,624,792 | B2 * | 12/2009 | Wright | E21B 33/06 166/321 |
| 8,936,078 | B2 * | 1/2015 | Richards | E21B 29/04 166/242.6 |
| 2001/0045283 | A1 * | 11/2001 | Leismer | E21B 29/04 166/242.6 |
| 2002/0046845 | A1 * | 4/2002 | Rayssiguier | E21B 41/00 166/381 |
| 2005/0126789 | A1 * | 6/2005 | Nivens | E21B 34/12 166/357 |
| 2010/0006289 | A1 * | 1/2010 | Spencer | E21B 36/04 166/292 |
| 2014/0208729 | A1 * | 7/2014 | Shaw | E21B 43/14 60/484 |
| 2014/0224503 | A1 | 8/2014 | Smith et al. | |
| 2014/0326470 | A1 | 11/2014 | Tinnen | |
| 2016/0186527 | A1 * | 6/2016 | Cocker, III | E21B 34/025 166/97.1 |
| 2016/0326822 | A1 * | 11/2016 | Tait | E21B 29/04 |
| 2019/0330951 | A1 * | 10/2019 | Thomas | E21B 34/04 |
| 2021/0032952 | A1 * | 2/2021 | Hatten | E21B 33/04 |
| 2021/0071481 | A1 * | 3/2021 | Al-Abdulrahman | E21B 33/035 |

* cited by examiner

SEPARABLE HOUSING ASSEMBLY FOR TUBULAR CONTROL CONDUITS

CROSS-REFERENCE TO RELATED APPLICATIONS

This application is a national stage entry of PCT/US2019/012548 filed Jan. 7, 2019, said application is expressly incorporated herein by reference in its entirety.

FIELD

The present technology relates to the wellbore abandonment phase. In particular, the present technology involves sealing downhole control lines for abandoning the wellbore.

BACKGROUND

For control of various downhole tools, small diameter tubular control conduits (also referred to as control lines) may run along with production tubing, or other tubulars, into a wellbore. Given the control by these tubular control conduits, these may be referred to as intelligent wells. The tubular control conduits may include fluids or electrical lines for communicating control signals to the downhole tools. As the control lines extend downhole they may be external to the production tubing and downhole tools, but may at various points pass through them, or may be connected by fittings to ports, channels or bores within the tubing and tools.

After the wellbore has undergone production and hydrocarbons extracted, the wellbore may then be abandoned. The abandonment phase involves processes to close the well and make it safe to the environment when left alone. Accordingly, in this phase a portion of the upper tubing may be removed and cement injected to isolate the wellbore and prevent the flow of fluids into unwanted regions, such as freshwater aquifers. The small diameter control lines may also be plugged with the cement during this process to prevent unwanted fluid flow.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
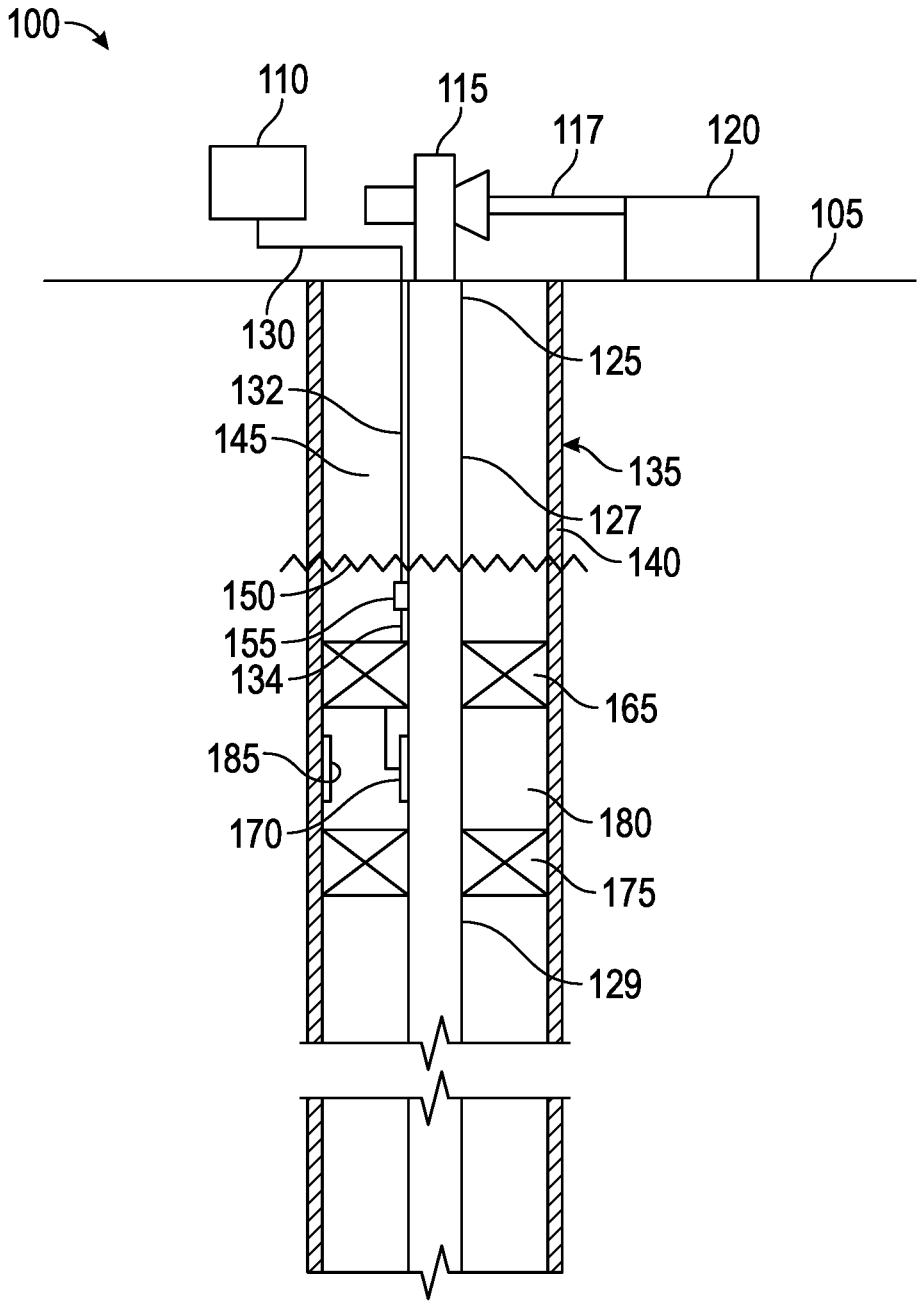
FIG. 1A is a schematic diagram of an exemplary wellbore environment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein. The terms "uphole" and "downhole," as used herein, are relative to the bottom or furthest extent of the wellbore, even though the wellbore or portions of it may be deviated and/or horizontal.

During the production phase of a wellbore, small diameter tubular control conduits (also referred to as control lines in the field) are employed to transmit control signals and power to various downhole tools. The tubular control conduits are provided parallel with production tubulars and reside, at least partially, in the annulus of the wellbore. Wellbore production involving the extraction of hydrocarbons to the surface is carried out until the production is too low, non-existent, or non-economical after which the wellbore may be abandoned.

During the abandonment phase, various tools and upper portions of tubulars can be retracted and removed from the wellbore. However, the lower portion of tubulars and other downhole tools may be left for permanent abandonment in the well. The wellbore may then be plugged. Mechanical plugs (e.g., bridge plugs) may be provided downhole and production and tubulars cemented to prevent crossflow or unwanted production. There may also be regulatory requirements which may require implementation of primary and secondary barriers downhole.

Due to the small diameter of tubular control conduits, cement may not be effective in entering into and/or sealing the tubular control conduits. If unsuccessful, the tubular control conduits may provide potential fluidic communication (for example, leak paths) through multiple barriers (for example, packers or bridge plugs) in the wellbore. This may result in harm to the environment.

Accordingly, disclosed herein is an apparatus, method and system for sealing a tubular control conduit, also referred to as control lines in the field, for well abandonment. The tubular control conduits (for example, control lines) can be hydraulic, electrical, chemical injection, fiber optic, and/or other lines disposed within the wellbore. While the present disclosure describes references to fluid and/or electric controls, it is within the scope of this disclosure to implement the present disclosure with any signals, including power, that may be sent through a tubular conduit. In particular, a separating member may be actuated, which may sever and/or obstruct an inner bore of the tubular control conduits, thus forming a seal and/or blocking any flow of fluids out from the tubular control conduits. The separating member may cut and/or collapse the inner bore of the tubular control conduits, thus separating one portion from another while also sealing fluidic communication within the inner bore of either portion of the tubular control conduits. The separating member may take a plurality of forms. For instance the separating member may involve rotation or translation and can include one or more cutting members, biasing elements, and/or a shear tubular control conduit.

FIG. 1A is a schematic of an exemplary wellbore environment 100 for implementation of the actuatable obstruction apparatus disclosed herein. As illustrated, is a wellbore 135 having production tubular 125 extending from a wellhead 115 at surface 105. The production tubular may be made up of a plurality of individual tubulars connected together, which in the field may be referred to as joints. A casing 140 runs along a length of the wellbore 135 and may be cemented in place. The wellhead 115 has valves, pumps and components for maintaining pressure and withdrawing produced hydrocarbon into container 120 via piping 117. Within the wellbore 135 may be packers 165 and 175 which may be set along the length of the production tubular 125 to prevent fluid flow and to isolate zones, such as zone 180.

A tubular control conduit 130 (may also be referred to as a control line in the field) extends from control device 110 at the surface 105 into the wellbore 135. The tubular control conduit 130 communicatively couples with a downhole tool 170. Communication signals may be transmitted between the control unit 110 and the downhole tool 170, with such communication signals including control (command) signals from the control device 110. The tubular control conduit 130 has an inner bore extending along its length which may contain a fluid or a conductor such as a wire, or conductive metal. Communication signals may be transmitted along the tubular control conduit 130 via the fluid or electrically via the conductor. When transmitted electrically, tubular control conduit 130 may be or may include a wire, cable or other conductor and may include a conductive metal. The tubular control conduit 130 runs adjacent the production tubular 125 within the annulus 145 between the production tubular 125 and casing 140 (or surface of the wellbore 135 in uncased portions of the well). The tubular control conduit 130 may pass through the packer 165, or may couple with ports on the packer which carry the fluid or electrical signal through the packer 165, or otherwise have conduits for transmitting signal electrically or fluidically. Although one control conduit 130 is shown, there may be employed a plurality of control conduits 130 of various types.

The downhole tool 170 may be actuated by the control device 110 via signal transmitted along the tubular control conduit 130. The downhole tool may be any number of tools which communicate with the surface and receive command signals, and may be a valve, sensor, or actuator which actuates (opens or closes) a valve in the tubular string 125, or opens a door 185 in the casing 140 or otherwise actuates or carries out an job or activity in the tubular string 125, wellbore 140, and/or casing 140, and/or measures a wellbore parameter.

As mentioned, hydrocarbons may be extracted and produced via the production tubular 125 to the surface 105. After period of time, the produced hydrocarbon may be too low or the costs of production too high to extract the hydrocarbon. At this time, or for any other reason requiring closing of the wellbore 135, the well may be prepared for abandonment. This abandonment phase involves the retraction of an upper portion of the tubulars, including production tubulars 125 and tubular control conduit 130. Other equipment and downhole tools may also be removed. As illustrated in FIG. 1A the cross-section 150 may be the position at which the tubulars, including the production tubulars 125 and tubular control conduit 130, may be retracted (i.e., withdrawn) and removed. Retraction may involve severing the tubulars, which may be carried out by cutting or by simply pulling with sufficient force, and/or additionally, placing weak points or severing points along the length of the tubular control conduit at which the tubulars may be severed. Additionally, severing may include pulling them from connections such as sealing devices (e.g., ferrule type connections). The cross-section 150 is just above the packers 165 so as to assist in isolating fluid further downhole.

The tubular control conduit 130 has an upper retractable segment 132 above the cross-section 150 and a lower abandonable segment 134 below the cross-section 150. When severed at the cross-section 150, the retractable segment 132 may be removed and the abandonable segment 134 may be left for permanent abandonment in the wellbore 135. Similarly, the production tubular 125 may also have an upper retractable segment 127 for removal above the cross-section 150 and a lower abandonable segment 129 to be left abandoned in the wellbore 135.

Figure 1B:
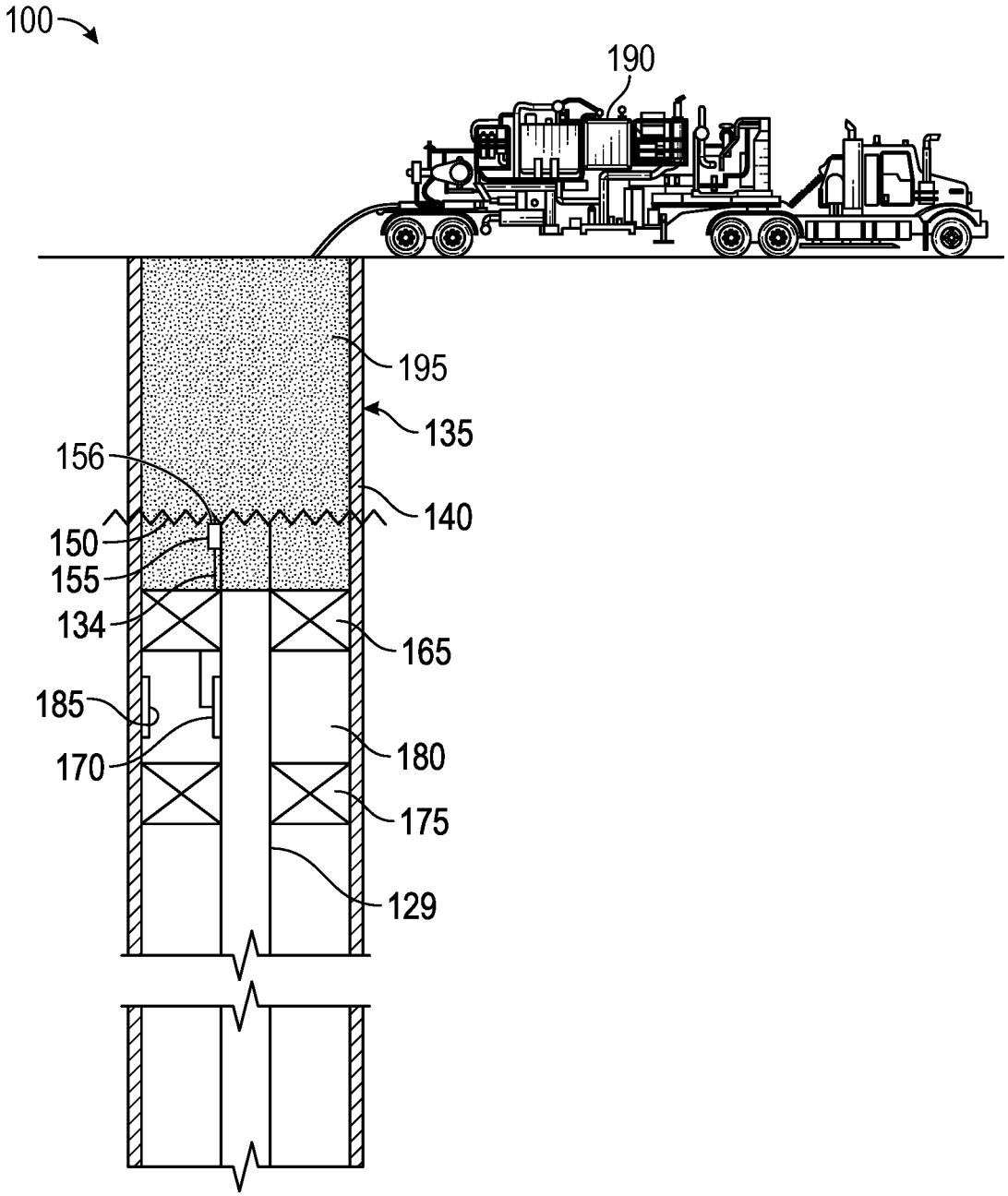
FIG. 1B is a schematic diagram of the exemplary wellbore environment of FIG. 1A after plugging.

FIG. 1B is a schematic of the wellbore environment 100 after plugging. In particular, cement 195 may be introduced, via pump for instance, into the wellbore 135. A cement truck 190 or other container or blending equipment may provide the cement 195. The cement 195 assists in plugging and preventing the flow of fluid. However, the diameter of the inner bore of the tubular control conduit 130 may be of a small size such that the cement 195 has difficulty entering and plugging the inner bore of the tubular control conduit 130. If the tubular control conduit 130 is not properly plugged, then fluid may pass between various isolated zones in the wellbore 135 along the length of the tubular control conduit 130 and may enter unwanted regions and/or harm the environment.

In order to assure sealing of the tubular control conduit 130, the tubular control conduit 130 may have an actuatable obstruction apparatus 155 as illustrated in FIG. 1A. The actuatable obstruction apparatus 155 may have an obstruction member that may seal or block the inner bore of the tubular control conduit 130 when actuated. The actuation can be carried out via severing and/or retracing the tubular control conduit 130, or activating by control signal via other tubular control conduits, or by particular predetermined manipulations of the tubular control conduit 130 (such as a jarring sequence). Various embodiments of the actuatable obstruction apparatus 155 and/or obstruction members are illustrated in the following FIGS. 2A-5.

Figure 2A:
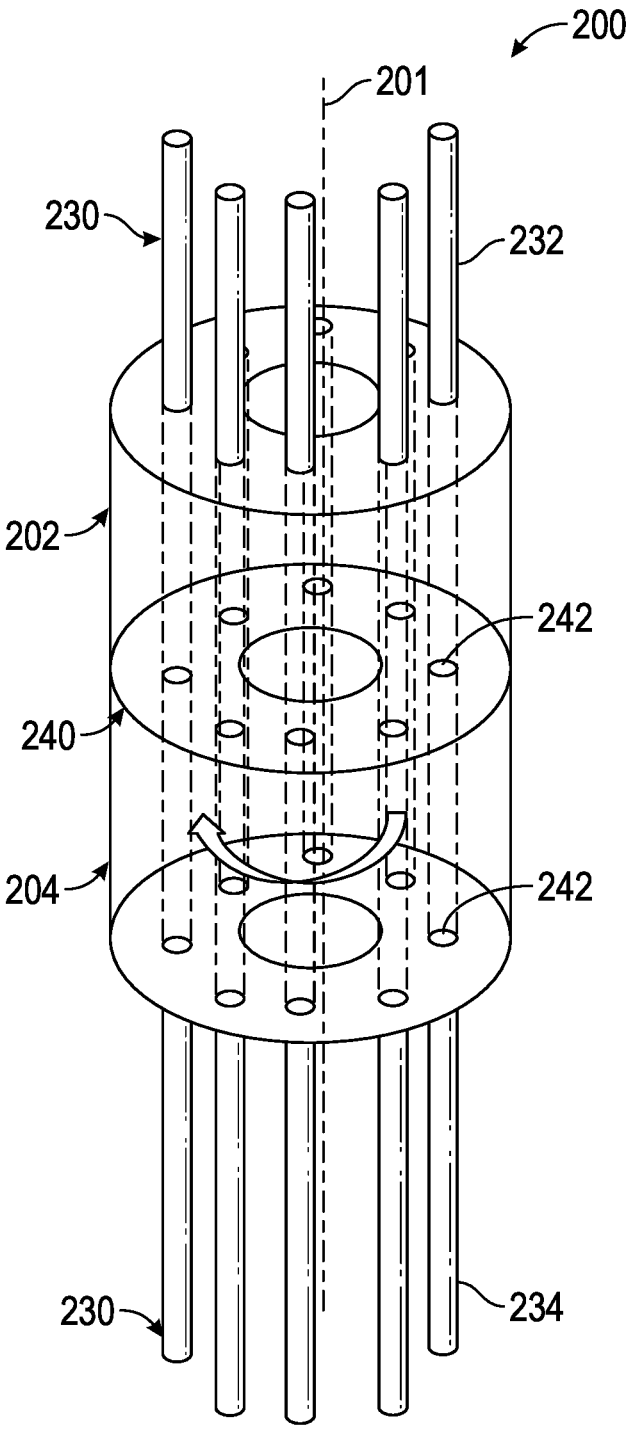
FIG. 2A is an exploded isometric view of a rotational manifold assembly.

FIG. 2A is an exploded isometric view of a rotational manifold assembly for use with one or more tubular control conduits. The manifold assembly 200 can receive one or more tubular control conduits 230 extending therethrough. While the manifold assembly 200 is illustrated as substantially circular with the one or more tubular control conduits 230 circumferentially arranged, it is within the scope of this disclosure to vary the shape and/or arrangement of the one or more tubular control conduits 230 within the shear assembly. The manifold assembly 200 can be disposed entirely within a housing and/or other sealed casing. The housing and/or sealed casing can provide protection for the one or more tubular control conduits 230 within the wellbore and/or downhole environment.

The manifold assembly 200 can include one or more tubular control conduits 230 having an upper portion 232 having a fluid flow inner bore formed therethrough along a longitudinal axis 201 and a lower portion 234 having a fluid flow inner bore formed therethrough along the longitudinal axis 201. The upper portion 232 and the lower portion 234 can be substantially aligned within the manifold assembly 200 providing fluid flow path between the upper portion 232 and the lower portion 234, thus forming a substantially continuous tubular control conduit within the manifold assembly 200. The manifold assembly 200 can be separable into an upper assembly 202 and a lower assembly 204 corresponding to the upper portion 232 and the lower portion 234 of the one or more tubular control conduits 230. In at least one instance, the upper assembly 202 and corresponding upper portion 232 of the one or more tubular control conduits 230 can be removed from the wellbore after separation of the manifold assembly 200 and the one or more tubular control conduits 230 received therein.

The manifold assembly 200 can have one or more seals 240 disposed between the upper portion 232 and the lower portion 234 of the one or more tubular control conduits 230. The one or more seals 240 can prevent fluid loss (for example, leakage) at the mesh point between the upper portion 232 and the lower portion 234 of the one or more tubular control conduits 230. In at least one instance, as illustrated in FIG. 2A, the one or more seals 240 can be a metal to metal seal having a corresponding number of apertures 242 formed therein. Each aperture 242 can correspond to a tubular control conduit 230 and align therewith during normal operation to provide a leak-free fluid flow path between the upper portion 232 and the lower portion 234 of the one or more tubular control conduits. While a metal to metal seal is illustrated as the one or more seals 240, it is within the scope of this disclosure to implement any sealing mechanism including but not limited to, elastomeric o-rings, metal o-rings, adhesive sealants, pressure-fit seal.

The manifold assembly 200 can be actuated between an aligned configuration and an unaligned configuration. The aligned configuration (as discussed further below with respect to FIG. 3A) can provide the fluid flow path between the upper portion 232 and lower portion 234 of the tubular control conduits 230. In an unaligned configuration, the one or more tubular control conduits 230 have been actuated so as to misalign and/or sever the upper portion 232 and the lower portion 234 of the one or more tubular control conduits 230. The misaligned upper portion 232 and lower portion 234 can prevent fluid flow through the inner bore of the one or more tubular control conduits 230, thus sealing the fluid flow from the wellbore and/or formation to the surface. The manifold assembly 200 can be actuated in a linear translation or by rotation to misalign and disconnect the upper portion 232 of a tubular control conduit 230 from the corresponding lower portion 234 of the tubular control conduit 230. The translation and/or rotation of the manifold assembly 200 can ensure the upper portion 232 and lower portion 234 are misaligned for each of the one or more tubular control conduits, including adjacent upper portions 232 and lower portions 234, respectively, in situations having more than one tubular control conduit 230. As detailed in FIG. 2A, the metal to metal seal 240 can have a solid portion between each of the one or more tubular control conduits 230, thus providing a sealing surface to the lower portion 234 and preventing fluid flow from the wellbore and/or formation from reaching surface. The upper portion 232 of the one or more tubular control conduits 230 can then be removed from the wellbore, and lower portion 234 can be sealed from leakage.

The manifold assembly 200 is actuatable by an actuation device producing an actuation force including, but not limited to, a biasing element, a burst plug, a pressurization event, and/or guide slot/guide pin arrangement. The actuation of the manifold assembly 200 can separate, shear, sever, pinch, and/or collapse the one or more tubular control conduits 230 allowing separation between the upper portion 232 and the lower portion 234 while also sealing the inner bore of the lower portion 234 from fluid flow at the separation point between the upper portion 232 and the lower portion 234. The actuation of the manifold 200 can simultaneously separate the upper portion 232 and lower portion 234 and tubular control conduit 230. The sealing of the lower portion 234 of the one or more tubular control conduits can prevent unwanted fluid flow from the formation and/or wellbore from flowing to the surface and/or flowing past an isolation device disposed within the wellbore.

Figure 2B:
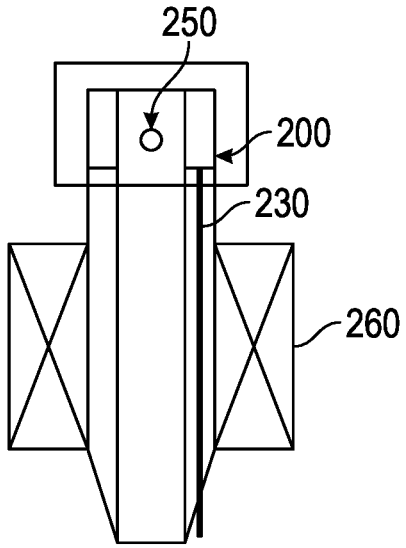
FIG. 2B is cross-section view of a manifold assembly.

FIG. 2B illustrates a lateral cross-sectional view of a manifold assembly detailing an actuation device. The manifold assembly 200 can include one or more actuation devices 250 configured to actuate the manifold assembly 200 between the aligned configuration and the unaligned configuration. The actuation device 250 of the manifold assembly 200 can be used to cut and/or isolate the one or more tubular control conduits 230. The actuation device 250 can be a burst plug actuated by a rupture of the burst plug due to fluid pressure increase. The burst plug can activate the manifold assembly to transition from the aligned configuration to the unaligned configuration by sever the splice between the upper portion 232 and the lower portion 234 of the one or more tubular control conduits 230.

The manifold assembly 200 can be attached to a tubing string (see FIGS. 1A and 1B) in addition to a wellbore isolation device 260 (for instance, a packer) for effective zonal isolation within the wellbore, plugging and/or abandonment operations. One or more of the wellbore isolation device 260 can be used to isolate an annulus while the manifold assembly 200 can isolate the one or more tubular control conduits 230. The one or more tubular control conduits 230 can extend longitudinally along the wellbore while the actuation device 250 can operate perpendicular to the longitudinal axis of the wellbore.

Figure 2C:
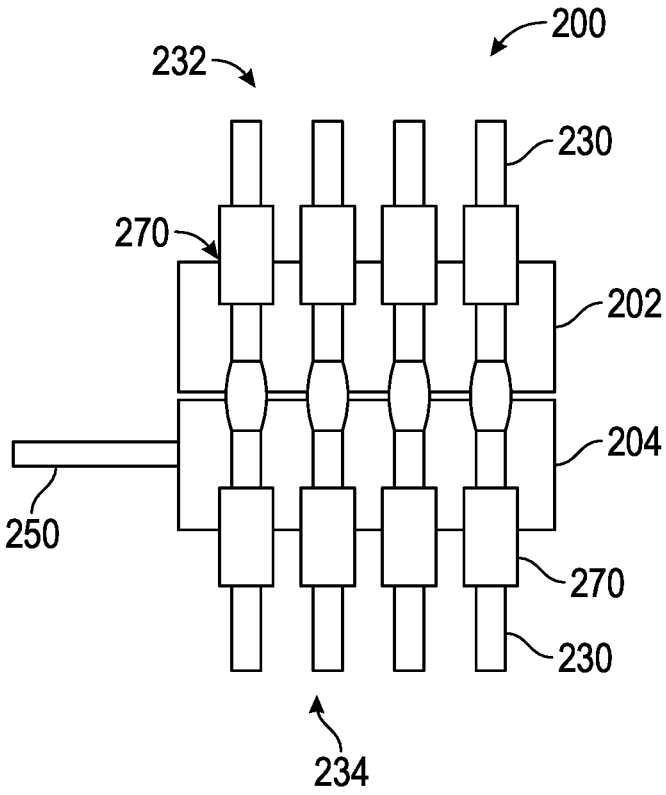
FIG. 2C is cross-section view of a linear manifold assembly in an aligned position.

FIG. 2C illustrates an example manifold assembly in an aligned configuration. The manifold assembly 200 can have one or more tubular control conduits 230 received therein. The one or more tubular control conduits 230 can have an upper portion 232 and a lower portion 234 spliced, joined, or otherwise coupled at the manifold assembly 200.

The upper portion 232 and the lower portion 234 of the one or more tubular control conduits 230 can be coupled at a connector 270. The connector 270 can couple the upper portion 232 and the lower portion 234 together, thus forming a sealed, leak proof connection for fluid flow therethrough. In at least one instance, the upper portion 232 and the lower portion 234 of each respective tubular control conduit 230 can be a ferrule type tubing connector. The upper portion 232 and the lower portion 234 of each respective tubular control conduit 230 can be coupled in any manner configured to join two tubular control conduits and provide a continuous inner bore for fluid flow therethrough without fluid loss.

Figure 2D:
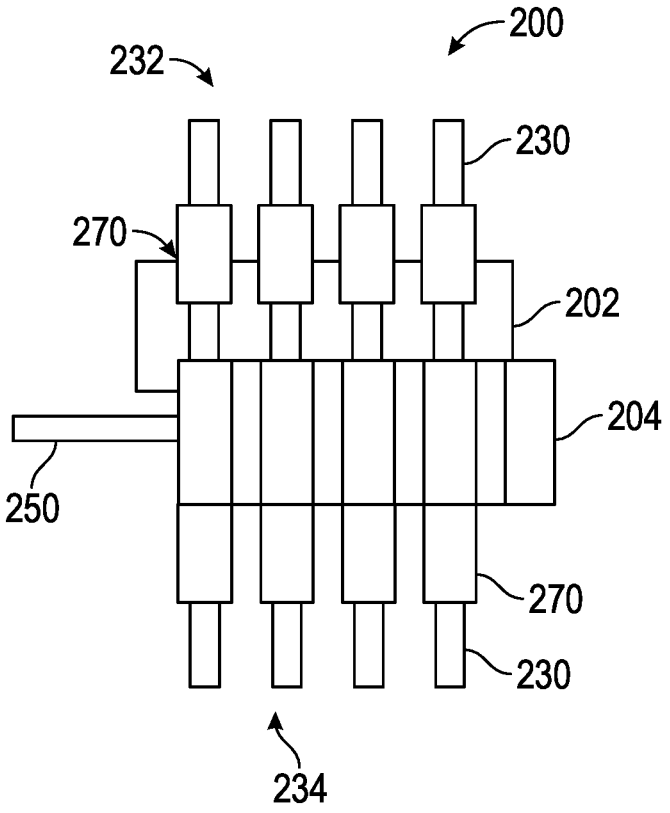
FIG. 2D is cross-section view of a linear manifold assembly in an unaligned position.

FIG. 2D illustrates an example manifold assembly in an unaligned configuration. The manifold assembly 200 can have one or more tubular control conduits 230 received therein. Upon actuation of the one or more actuation device 250, at least a portion of the manifold assembly 200 can displace to place at least a portion of the lower portion 234 and/or at least a portion of the upper portion 232 misaligned with the remaining portions of each respective one or more tubular control conduit 230.

The lateral displacement of at least a portion of the manifold assembly 200 can sever, separate, or otherwise disconnect the upper portion 232 from the lower portion of the one or more tubular control conduits 230. The lower portion 234 can align with the one or more seals 240 to prevent fluid flow from the wellbore and/or formation to the surface. After actuation of the manifold assembly 200 and separation between the upper portion 232 from the lower portion 234 of the one or more tubular control conduits 230, the upper portion 232 of the one or more tubular control conduits 230 can be removed from the wellbore to surface for re-use, recycling, and/or repair.

While FIGS. 2C and 2D illustrate a linear translation of the manifold assembly 200, it is within the scope of this disclosure to implement other actuation of the manifold assembly including rotational displacement (FIG. 2A). Further, it is within the scope of this disclosure to implement J-slots, or similar features, to translate a linear motion from the actuation device 250 to a rotational motion.

Figure 3A:
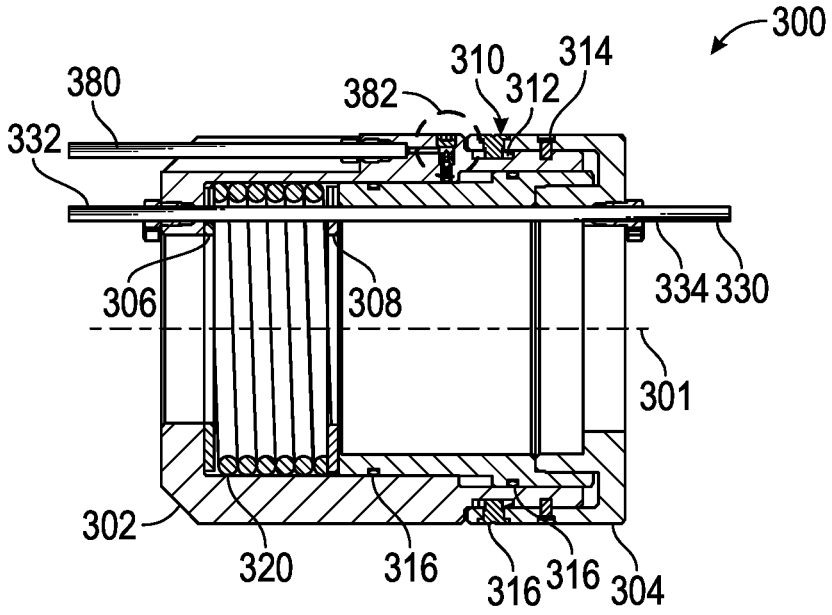
FIG. 3A is cross-section view of a guide pin tubular control conduit shear assembly in an unseparated position.

FIG. 3A is a sectional view of a biased shear manifold assembly. A shear assembly 300 can be disposed within a wellbore and can be adjacently uphole from a wellbore isolation device. The shear assembly 300 can have one or more tubular control conduits 330 received therein. The one or more tubular control conduits 330 can be hydraulic and/or electric tubulars received within the shear assembly 300. The shear assembly 300 can receive any number of tubular control conduits 330. While FIG. 3C illustrates five (5) tubular control conduits 330 circumferentially disposed within the shear assembly 300, it is within the scope of this disclosure to include more or fewer tubular control conduits 330 including, but not limited to, one, two, three, four, six, seven, and ten, or any plurality of tubular control conduits 330.

The shear assembly 300 can be formed from an upper assembly 302 and a lower assembly 304 coupled together. The upper assembly 302 can have an upper shear plate 306 disposed therein and the lower assembly 304 can have a lower shear plate 308 disposed therein. The upper assembly 304 and lower assembly 304 can be separably coupled one to the other and can be separated by a predetermined actuation force. The upper assembly 302 and lower assembly 304 can be coupled together by a shear pin 410 secured in place by a shear ring 314. The shear pin 410 can be operable to shear at a predetermined pressure supplied by an actuation force, thereby separating the upper assembly 302 form the lower assembly 304. The upper assembly 302 and the lower assembly 304 can further include one or more seals 316 sealing the shear assembly 300 from fluid leakage between the upper assembly 302 and the lower assembly 304. The one or more seals 316 can include, but is not limited to, elastomeric o-rings, metal o-rings, and/or sealants.

The one or more tubular control conduits 330 can extend along a portion of the longitudinal axis 301 of the shear assembly 300. During certain wellbore operations, the one or more tubular control conduits 330 can be severed, separated, or otherwise disconnected into an upper portion 332 and a lower portion 334. In some instances, the upper portion 332 of the one or more tubular control conduits 330 can be removed from the wellbore for repair, reuse, and/or recycling.

The shear assembly 300 can have an actuation device operable to separate the upper assembly 302 and the lower assembly 304 of the shear assembly 300. The actuation device can be an actuation control conduit 380 operable to separate the upper assembly 302 and the lower assembly 304 of the shear assembly 300, thus separating the one or more tubular control conduits 330 into the upper portion 332 and the lower portion 334. The actuation control conduit 330 can be a longitudinally extending tubular conduit extending substantially parallel with the one or more tubular control conduits 330 within the shear assembly 330. The actuation control conduit 380 can be received within the shear assembly 300 and coupled with a check valve 382.

Figure 3B:
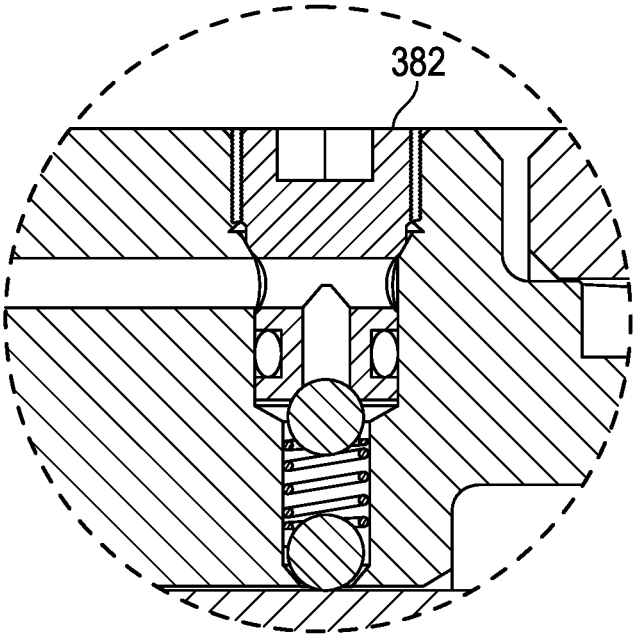
FIG. 3B is a detailed view of a check vale assembly shown in FIG. 3A.
Figure 3C:
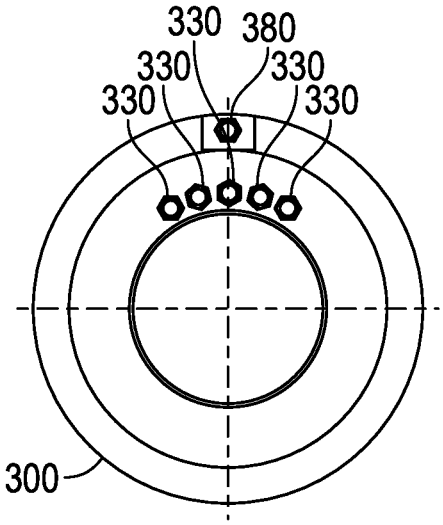
FIG. 3C is a lateral perpendicular of a shear assembly.

FIG. 3B details a check valve of a shear assembly. The check valve 382 can isolate the actuation control conduit 380 in both an inflow and outflow direction. The actuation control conduit 380 can receive a fluid flow within a fluid flow bore formed therein. The fluid flow can generate a pressurization within the shear assembly 300 urging separation between the upper shear plate 306 and the lower shear plate 308 and thus urging separation between the upper portion 332 and the lower portion 334 of the one or more tubular control conduits 330.

Referring back to FIG. 3A, the shear assembly 300 can further include a guide pin 310 and a guide slot 312. The guide pin 310 can be disposed on one of the upper assembly 302 or the lower assembly 304 and the guide slot 312 disposed on the other of the upper assembly 302 or the lower assembly 304. The guide pin 310 can be at least partially received within the guide slot 312. The guide slot 312 can provide a pathway and/or track within which the guide pin 310 can travel during separation between the upper assembly 302 and lower assembly 304. In at least one instance, the guide slot 312 can be a J-slot, or other angled pathway providing linear translation and rotation of the upper assembly 302 relative to the lower assembly 304.

The shear assembly 300 can also include the upper shear plate 306 and the lower shear plate 308 disposed within the upper assembly 302 and the lower assembly 304 respectively. The upper shear plate 306 can abuttingly engage with the upper portion 332 of the one or more tubular control conduits 330 and the lower shear plate 308 can abuttingly engage with the lower portion 334 of the one or more tubular control conduits 330. The upper shear plate 306 and the lower shear plate 308 can be operable to sever, shear, or otherwise disconnect the upper portion 332 from the lower portion 334 of the one or more tubular control conduits 330 upon separation of the upper assembly 302 from the lower assembly 304.

The shear assembly 300 can further include a biasing element 320 to assist in separation between the upper assembly 302 and the lower assembly 304. The biasing element 320 can be a coil spring, linear actuator, or other element biasing the upper assembly 302 away from the lower assembly 304. The biasing element 320 can be in a compressed or unextended position when the shear assembly 300 is assembled and prior to separation of the upper assembly 302 from the lower assembly 304.

During separation of the shear assembly 300, pressurization of the actuation control conduit 380 can provide a separation, or actuation, force to urge separation between the upper assembly 302 and the lower assembly 304. The separation force can cause movement the guide pin 310 within the guide slot 312, which can impart rotation of the upper assembly 302 relation to the lower assembly 304. The rotation of the upper assembly 302 and/or the lower assembly 304 can cause the upper shear plate 306 to sever or shear the upper portion 332 of the one or more tubular control conduits 330, while the lower shear plate 308 can sever or shear the lower portion 334 of the one or more tubular control conduits 330. Upon shear of the one or more tubular control conduits 330, the shear assembly 300 can be separated into the respective upper assembly 302 and the lower assembly 304, with the biasing element 320 further urging separation. The upper portion 332 of the one or more tubular control conduits 330 can then be removed from the wellbore. In some instances, the upper assembly 302 of the shear assembly 300 can be removed along with the upper portion 332 of the one or more tubular control conduits.

Figure 3D:
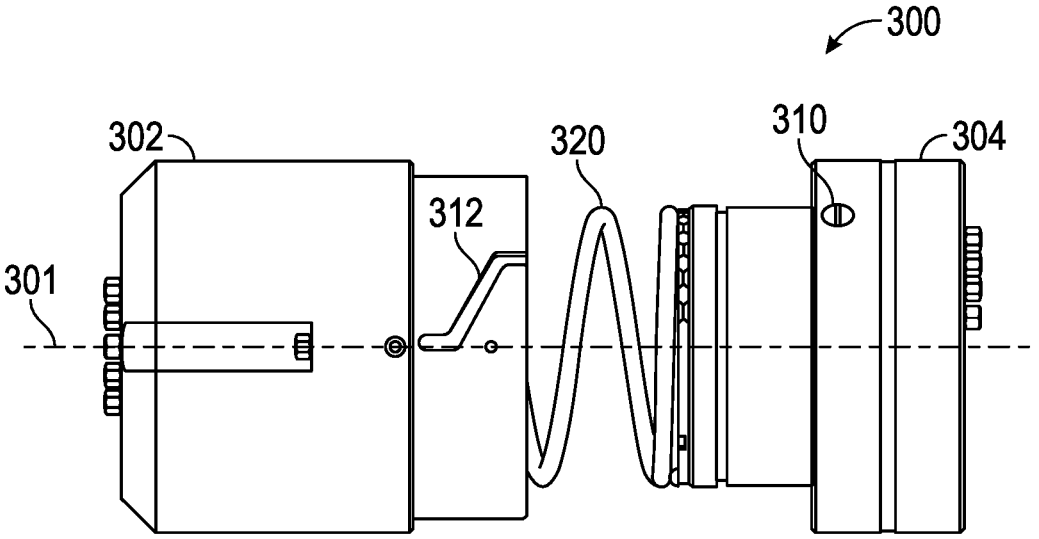
FIG. 3D is planar view of a guide pin tubular control conduit shear assembly in a separated position.
Figure 3E:
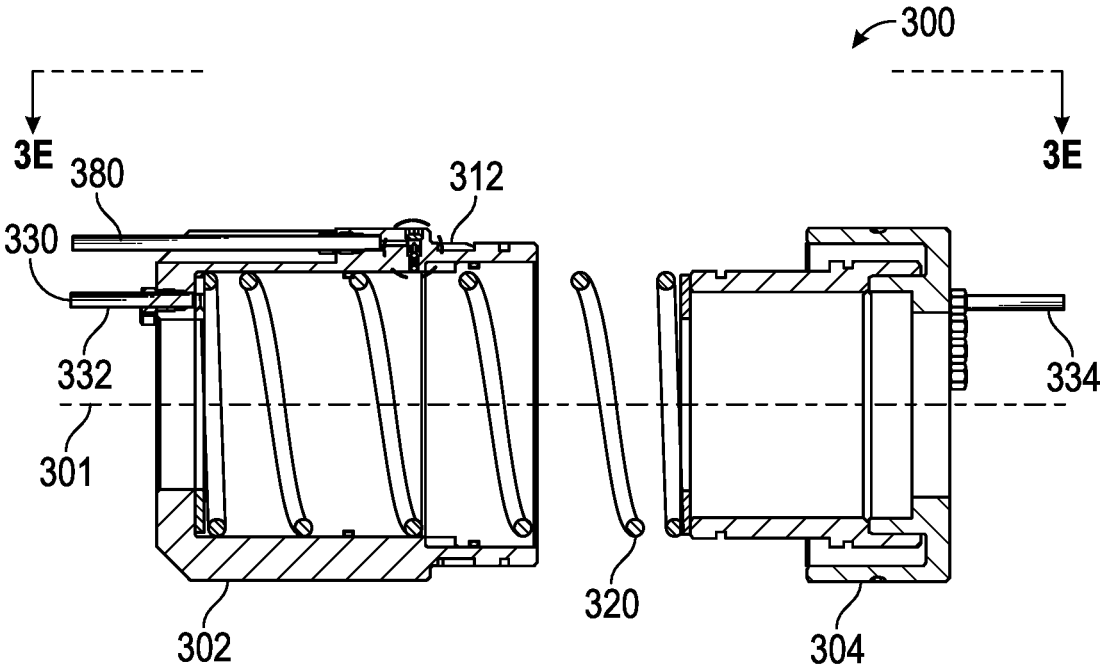
FIG. 3E is longitudinal cross-section view of a guide pin tubular control conduit shear assembly in a separated position.

FIG. 3D is a planar view of a shear assembly in a sheared condition. FIG. 3E is a cross-section view of a shear assembly in a sheared condition. In a fully sheared condition, the guide pin 312 can be transitioned out of the guide slot 310 as the actuation force and the biasing element 320 separate the upper assembly 302 and the lower assembly 304 of the shear assembly. The one or more tubular control conduits 330 that are received within the shear assembly 300 can be sheared and/or severed by the upper shear plate 306 and the lower shear plate 308, respectively, allowing the upper assembly 302 and upper portion 332 of the one or more tubular control conduits 330 to be removed from the wellbore.

Figure 4:
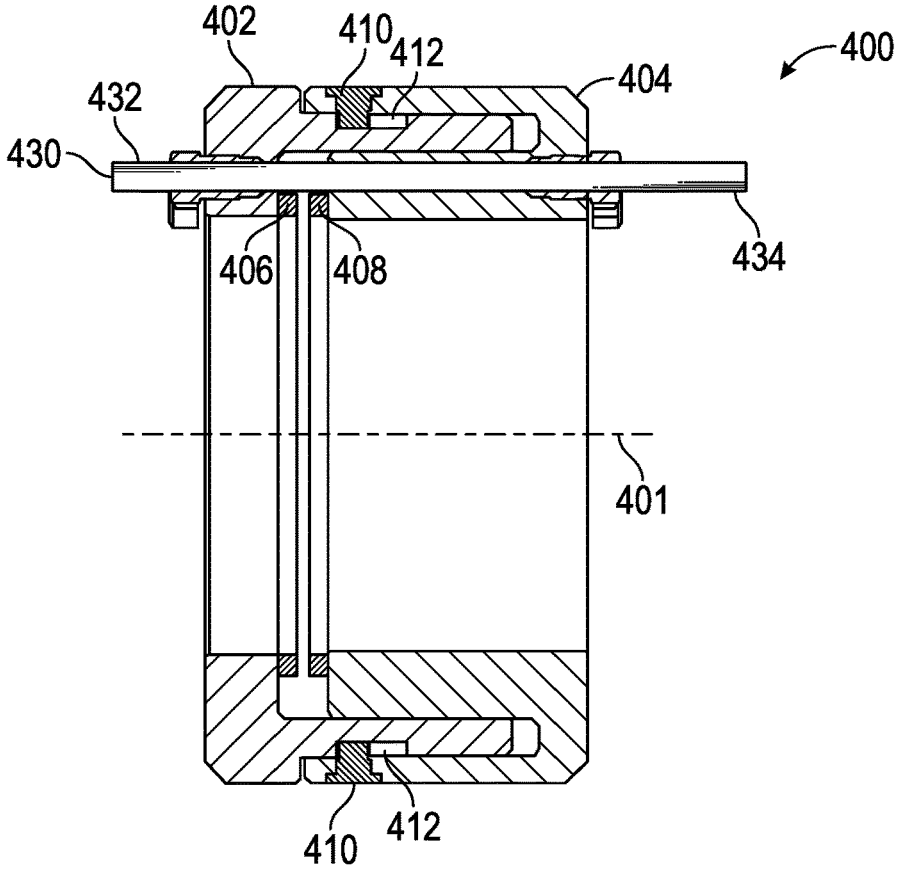
FIG. 4 is cross-section view of a biased guide pin tubular control conduit shear assembly in an unseparated position.

FIG. 4 is an unbiased shear assembly having one or more tubular control conduits received therein. A shear assembly 400 can have one or more tubular control conduits 430 received therein. The one or more tubular control conduits 430 can extend along a longitudinal axis 401 and have an inner bore formed therethrough. The shear assembly 400 can have an upper assembly 402 and a lower assembly 404 separably coupled together. The upper assembly 402 can have an upper shear plate 406 disposed therein and the lower assembly 404 can have a lower shear plate 408 disposed therein. The upper assembly 402 and lower assembly 404 can be separably coupled one to the other and can be separated by a predetermined actuation force.

The shear assembly 400 is actuatable between an unsheared configuration to a sheared configuration by one or more actuation devices. The actuation of the one or more actuation devices can separate the upper assembly 402 from the lower assembly 404 and sever and/or shear the one or more tubular control conduits 430.

The one or more tubular control conduits 430 can have an upper portion 432 and a lower portion 434. The upper portion 432 can generally be received and disposed within the upper assembly 402 and the lower portion 434 can generally be received and disposed within the lower assembly 404.

An upper shear plate 406 and/or a lower shear blade 408 can be disposed within the upper assembly 402 and the lower assembly respectively to assist with shearing of the one or more tubular control conduits 430. The upper shear plate 406 and the lower shear plate 408 can be a sharp, blade like element operable to separate and/or shear the one or more tubular control conduits 430.

A guide pin 410 and a guide slot 412 can be formed on the shear assembly 400. The guide pin 410 can be disposed on one of the upper assembly 402 or the lower assembly 404 and the guide slot 412 disposed on the other of the upper assembly 402 or the lower assembly 404. The guide pin 410 can be at least partially received within the guide slot 412. The guide slot 412 can provide a pathway and/or track within which the guide pin 410 can travel during separation between the upper assembly 402 and lower assembly 404. In at least one instance, the guide slot 412 can be a J-slot, or other angled pathway providing linear translation and rotation of the upper assembly 402 relative to the lower assembly 404.

During separation of the shear assembly 400, an actuation force can be applied to the upper portion 432 of the one or more tubular control conduits 430 urging the guide pin 410 to transition within the guide slot 412. In at least one instance the actuation force can be sufficient to shear the one or more tubular control conduits 430. In other instances, movement of the guide pin 410 within the guide slot 412 can cause the one or more tubular control conduits to engage with an upper shear plate 406 and/or a lower shear plate 408, thereby shearing the one or more tubular control conduits 430. The actuation force can further separate the upper assembly 402 from the lower assembly 404 of the shear assembly. The guide pin 410 can transition out of and away from the guide slot 412 thereby completely separating the upper assembly 402 from the lower assembly 404. The upper assembly 402 can then be pulled uphole and removed from the wellbore enabling reuse, repair, and/or recycling of the one or more tubular control conduits 420.

Figure 5:
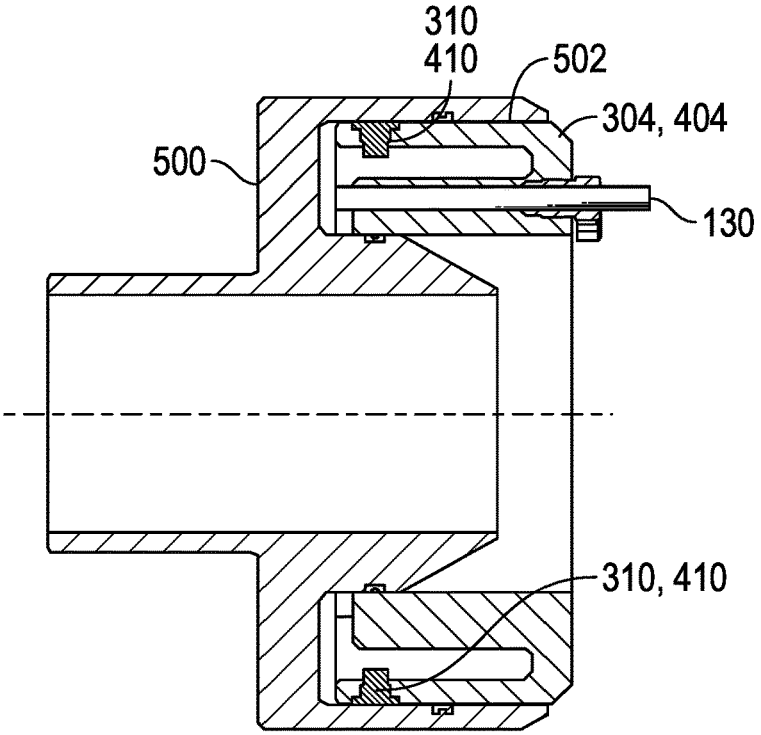
FIG. 5 is cross-sectional view of a tubular control conduit isolation cap.

FIG. 5 illustrates an isolation cap for use with a manifold and/or shear assembly. After removal of at least a portion of the one or more tubular control conduits 130 from the wellbore, an isolation cap 500 can be placed in the wellbore and disposed over the remaining portion of the one or more tubular control conduits 130. The isolation cap 500 can be disposed over the lower, abandonable segment 134 of the one or more tubular control conduits 130 to provide an additional seal against fluid leakage from the wellbore and/or formation to surface through the inner bore of the one or more tubular control conduits. 130. The isolation cap 500 can be placed within the wellbore after the upper, retractable segment 132 of the one or more tubular control conduits has been removed from the wellbore.

The isolation cap 500 can have one or more securement elements 502 operable to engage with at least a portion of the manifold assembly and/or shear assembly remaining within the wellbore. The securement elements 502 can include, but is not limited to, a tongue/groove arrangement, a ratchet engagement arrangement, and/or a surface abutment arrangement. The one or more securement elements 502 can be operable to engage with the remaining portion of the manifold assembly and/or shear assembly and prevent undesirable de-coupling. In at least one instance, the one or more securement elements 502 can be a tongue (or other protrusion) formed on the isolation cap 500 and operable to engage with a corresponding groove formed on the manifold assembly and/or shear assembly. In other instances, the one or more securement elements 502 can be a groove formed on the isolation cap 500 and operable to engage with a corresponding tongue (or other protrusion) formed on the manifold assembly and/or shear assembly.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. Rather, the described features and steps are disclosed as possible components of systems and methods within the scope of the appended claims.

What is claimed is:

1. An apparatus comprising:

a separable housing having a longitudinal axis, the separable housing having an upper portion and a lower portion;

a tubular control conduit disposed within the separable housing and extending along the longitudinal axis, the tubular control conduit having an inner bore formed therein and having an upper portion corresponding to the upper portion of the separable housing and a lower portion corresponding to the lower portion of the separable housing;

an actuation device coupled with the separable housing, the actuation device operable to separate the upper portion and the lower portion of the separable housing thereby separating the tubular control conduit, and interrupting the inner bore of the tubular control conduit;

wherein a metal to metal seal disposed between the upper portion and the lower portion of each one or more tubular control conduits interrupts the inner bore of the one or more tubular control conduits after the actuation device operates to separate the upper portion and the lower portion of the separable housing; and wherein linear displacement of the upper and lower portion of the separable housing as a result of operation of the actuation device seals the tubular control conduit.

2. The apparatus of claim 1, wherein the upper portion of the separable housing is rotatable around the longitudinal axis relative to the lower portion of the separable housing.

3. The apparatus of claim 2, wherein the actuation device includes a guide pin disposed on one of the upper portion and the lower portion of the separable housing and a guide slot disposed on the other of the upper portion and the lower portion of the separable housing.

4. The apparatus of claim 3, wherein the guide slot is a J-slot having at least a portion formed at an angle relative to the longitudinal axis imparting rotation on the separable housing as the guide pin moves therein.

5. The apparatus of claim 3, further comprising one or more shear plates coupled with the upper portion and/or the lower portion of the separable housing.

6. The apparatus of claim 2, wherein the actuation device comprises a tubular actuation control conduit, the tubular actuation control conduit having a fluid flow path along the longitudinal axis of the separable housing, the fluid flow path operable to receive a pressurization force operable to separate the upper portion of the separable housing from the lower portion of the separable housing.

7. The apparatus of claim 6, further comprising a check valve disposed in the separable housing and in fluidic communication with the tubular actuation control conduit.

8. The apparatus of claim 2, further comprising a biasing element disposed between the upper portion and the lower portion of the separable housing, the biasing element operable bias the upper portion away from the lower portion of the separable housing.

9. The apparatus of claim 1, wherein the actuation device operates to separate the upper and lower portion of the separable housing by a burst plug, the burst plug providing an actuation force.

10. The apparatus of claim 1, wherein the actuation device comprises a pressurization event.

11. The apparatus of claim 1, further comprising an isolation cap operable to couple with the lower portion of the separable housing.

12. A method comprising:

in response to receiving a signal transmitted by a control device, actuating one or more actuation elements to sever one or more tubular control conduits received within a separable housing, the separable housing having an upper portion and a lower portion, wherein a metal to metal seal forms in the one or more tubular control conduits as a result of actuating the one or more actuation elements;

as a result of actuating the one or more actuation elements, decoupling the upper portion of the separable housing from the lower portion of the separable housing; and extracting an upper portion of the one or more tubular control conduits disposed in a wellbore.

13. The method of claim 12, further comprising transmitting, via an actuation control conduit a communication signal.

14. The method of claim 13, wherein the communication signal is a pressurization signal to the one or more actuation elements.

15. The method of claim 12, wherein actuating the one or more actuation elements comprises rotation of one of the upper portion or lower portion of the separable housing.

16. The method of claim 12, wherein the one or more actuation elements is a guide pin disposed on one of the upper portion and the lower portion of the separable housing and a guide slot disposed on the other of the upper portion and the lower portion of the separable housing.

17. The method of claim 12, wherein actuation of the one or more actuation elements shears the one or more tubular control conduits.

* * * * *